US009180938B2

(12) United States Patent
Yoo et al.

(10) Patent No.: US 9,180,938 B2
(45) Date of Patent: Nov. 10, 2015

(54) LIQUEFIED GAS STORAGE TANK AND MARINE STRUCTURE INCLUDING THE SAME

(75) Inventors: Byeong Yong Yoo, Seoul (KR); Min Cheol Ryu, Gyeongsangnam-do (KR); Bong Hyun Cho, Gyeonggi-do (KR); Jae Ryu Bae, Gyeongsangnam-do (KR)

(73) Assignee: Daewoo Shipbuilding & Marine Engineering Co., Ltd., Seoul (KR)

( * ) Notice: Subject to any disclaimer, the term of this patent is extended or adjusted under 35 U.S.C. 154(b) by 1057 days.

(21) Appl. No.: 12/544,796

(22) Filed: Aug. 20, 2009

(65) Prior Publication Data

US 2010/0058780 A1 Mar. 11, 2010

(30) Foreign Application Priority Data

Aug. 21, 2008 (KR) ..... 10-2008-0081676
Apr. 27, 2009 (KR) ..... 10-2009-0036404
Apr. 29, 2009 (KR) ..... 10-2009-0037864

(51) Int. Cl.
*F17C 13/08* (2006.01)
*B63B 25/08* (2006.01)
(Continued)

(52) U.S. Cl.
CPC ..... *B63B 25/16* (2013.01); *B63B 25/08* (2013.01); *B63B 25/14* (2013.01); *F17C 3/027* (2013.01);
(Continued)

(58) Field of Classification Search
CPC ..... F17C 13/082; F17C 3/027; F17C 2270/0102; F17C 2270/0105; F17C 2270/011; F17C 2205/0119; F17C 2201/0166; F17C 2201/0171; F17C 3/025; F17C 2205/0379; F17C 2221/033; F17C 2223/0161; F17C 2270/0113; F17C 2270/0115; F17C 2270/0121; F17C 2270/0123; B63B 25/14; B63B 25/16; B63B 11/02; B63B 25/08; B63B 2025/087
USPC ..... 62/53.2; 220/553, 560.04, 562–564, 220/746; 114/74 A, 74 R, 72–78
See application file for complete search history.

(56) References Cited

U.S. PATENT DOCUMENTS 991,507 A * 5/1911 Hitchfield ..... 114/74 R
2,795,937 A * 6/1957 Sattler et al. ..... 62/7
(Continued)

FOREIGN PATENT DOCUMENTS

DE 43 25 884 7/1994
GB 1 216 179 12/1970
(Continued)

OTHER PUBLICATIONS

EP Search Report dated Dec. 28, 2009, issued in corresponding EP Applicatio No. 09010739.2.

*Primary Examiner* — Frantz Jules
*Assistant Examiner* — Keith Raymond
(74) *Attorney, Agent, or Firm* — Baker & Hostetler LLP

(57) ABSTRACT

The present disclosure relates to a liquefied gas storage tank and a marine structure including the same. The storage tank includes a plurality of liquefied gas storage tanks received in a plurality of spaces defined in a hull of the marine structure by a cofferdam and arranged in two rows. The cofferdam includes at least one longitudinal cofferdam extending in a longitudinal direction of the hull and at least one transverse cofferdam extending in a transverse direction of the hull. Each of the storage tanks is sealed and thermally insulated by a sealing wall and a thermal insulation wall extending without being disconnected. The longitudinal cofferdam supports load of an upper structure while suppressing a sloshing phenomenon.

15 Claims, 10 Drawing Sheets

(51) Int. Cl.
*B63B 25/16* (2006.01)
*B63B 25/14* (2006.01)
*F17C 3/02* (2006.01)

(52) U.S. Cl.
CPC ..... *F17C 13/082* (2013.01); *B63B 2025/087* (2013.01); *F17C 2201/0157* (2013.01); *F17C 2201/0166* (2013.01); *F17C 2201/0171* (2013.01); *F17C 2201/052* (2013.01); *F17C 2203/013* (2013.01); *F17C 2203/0358* (2013.01); *F17C 2203/0631* (2013.01); *F17C 2205/013* (2013.01); *F17C 2205/0142* (2013.01); *F17C 2205/0323* (2013.01); *F17C 2205/0379* (2013.01); *F17C 2221/033* (2013.01); *F17C 2221/035* (2013.01); *F17C 2223/0161* (2013.01); *F17C 2223/047* (2013.01); *F17C 2225/0161* (2013.01); *F17C 2225/047* (2013.01); *F17C 2227/0135* (2013.01); *F17C 2227/0178* (2013.01); *F17C 2227/039* (2013.01); *F17C 2227/0337* (2013.01); *F17C 2227/0341* (2013.01); *F17C 2227/0344* (2013.01); *F17C 2227/0348* (2013.01); *F17C 2227/0351* (2013.01); *F17C 2227/0355* (2013.01); *F17C 2227/0381* (2013.01); *F17C 2260/013* (2013.01); *F17C 2260/015* (2013.01); *F17C 2260/016* (2013.01); *F17C 2260/025* (2013.01); *F17C 2265/031* (2013.01); *F17C 2265/05* (2013.01); *F17C 2270/011* (2013.01); *F17C 2270/0105* (2013.01); *F17C 2270/0107* (2013.01); *F17C 2270/0113* (2013.01)

(56) References Cited

U.S. PATENT DOCUMENTS

| | | | | | |
|---|---|---|---|---|---|
| 2,896,416 | A | * | 7/1959 | Henry | 62/53.2 |
| 2,986,011 | A | * | 5/1961 | Murphy | 62/53.2 |
| 3,085,538 | A | | 4/1963 | Henry | |
| 3,109,294 | A | * | 11/1963 | Messer | 62/53.2 |
| 3,213,632 | A | | 10/1965 | Valk et al. | |
| 3,319,431 | A | * | 5/1967 | Clarke et al. | 62/53.2 |
| 3,326,167 | A | * | 6/1967 | Delli | 114/74 A |
| 3,659,543 | A | | 5/1972 | Basile et al. | |
| 3,875,886 | A | | 4/1975 | Glasfeld et al. | |
| 5,269,247 | A | | 12/1993 | Jean | |
| 5,501,359 | A | | 3/1996 | Chauvin et al. | |
| 2005/0005831 | A1 | * | 1/2005 | Krason et al. | 114/74 R |

FOREIGN PATENT DOCUMENTS

| | | |
|---|---|---|
| JP | 1994-35798 | 5/1994 |
| JP | 2006 143003 | 6/2006 |
| KR | 10-0785475 | 12/2007 |

* cited by examiner

Prior Art

Prior Art

LIQUEFIED GAS STORAGE TANK AND MARINE STRUCTURE INCLUDING THE SAME

CROSS-REFERENCE

This application claims priority from and the benefit of Korean Patent Application Nos. 10-2008-0081676, 10-2009-0036404 & 10-2009-0037864, filed on Aug. 21, 2008, Apr. 27, 2009 & Apr. 29, 2009, which are hereby incorporated by reference for all purposes as if fully set forth herein.

TECHNICAL FIELD

The present disclosure relates to liquefied gas storage tanks for storing a liquefied gas such as liquefied natural gas (LNG) and liquefied petroleum gas (LPG) and, more particularly, to a liquefied gas storage tank that includes a plurality of storage tanks arranged in two rows and received in a plurality of spaces, which is defined by a longitudinal cofferdam supporting load of an upper structure while suppressing a sloshing phenomenon, and to a marine structure including the same.

BACKGROUND

Natural gas is transported long distances in a gaseous state to consumers through a gas pipe line over land or sea, or is transported in a liquefied gas (LNG or LPG) state by carriers. Liquefied gas is obtained by cooling natural gas to a cryogenic state (about −163° C.) where the volume of the natural gas is reduced to about 1/600 of that at standard temperature and pressure, which makes it eminently suitable for long distance marine transportation.

An LNG carrier is designed to transport LNG at sea to consumers on land and includes liquefied gas storage tanks capable of sustaining the cryogenic temperature of the LNG. The storage tanks arranged in the LNG carrier can be classified into independent type storage tanks and membrane type storage tanks according to whether load of a cargo directly acts on a heat insulating material.

The independent type storage tank includes an SPB type tank and a Moss type tank, which are generally fabricated using a large quantity of non-ferrous metal as a main material, thereby causing a significant increase in manufacturing costs. Currently, the membrane type storage tanks are generally used as the liquefied gas storage tank. The membrane type storage tank is relatively inexpensive and is verified through application to the field of liquefied gas storage tanks without causing safety problems for a long period of time.

The membrane tanks are classified into a GTT No. 96 type and a Mark III type, which are disclosed in U.S. Pat. No. 5,269,247, No. 5,501,359, etc.

The GTT No. 96 type storage tank includes primary and secondary sealing walls comprising 0.5~0.7 mm thick Invar steel (36% Ni), and primary and secondary thermal insulation walls comprising a plywood box and perlite, which are stacked on an inner surface of the hull.

For the GTT No. 96 type, since the primary and secondary sealing walls have substantially the same liquid-tight properties and strength, it is possible to ensure safety in sustaining a cargo for a significantly long period of time even after the primary sealing wall is damaged to cause leakage of the cargo. Further, since the sealing walls of the GTT No. 96 type are composed of linear membranes, welding can be more conveniently performed than on the Mark III-type composed of corrugated membranes, thereby providing a higher degree of welding automation and a greater overall welding length than the Mark III-type. Further, the GTT No. 96 type employs a double couple to support heat-insulating boxes, that is, the thermal insulation walls.

The Mark III-type storage tank includes a primary sealing wall composed of a 1.2 mm thick stainless steel membrane, a secondary sealing wall composed of a triplex, and primary and secondary thermal insulation walls composed of polyurethane foam and the like, which are stacked on an inner surface of the hull.

For the Mark III-type, the sealing walls have a corrugated part which absorbs contraction by LNG stored in a cryogenic state, so that large stress is not generated in the membrane. For the Mark III-type, a heat-insulating system does not allow structural reinforcement due to the internal structure thereof and the secondary sealing wall does not sufficiently ensure prevention of LNG leakage compared to the secondary sealing wall of the GTT No. 96 type.

Since the membrane type LNG storage tank has lower strength than the independent type storage tank due to the structural characteristics thereof, the membrane type LNG storage tank is very vulnerable to liquid sloshing. Herein, the term "sloshing" refers to movement of a liquid material, that is, LNG, accommodated in the storage tank while a vessel sails in various marine conditions. The wall of the storage tank is subjected to severe impact by sloshing.

Since such a sloshing phenomenon inevitably occurs during voyage of the vessel, it is necessary to design the storage tank to have sufficient strength capable of sustaining the impact force by sloshing.

FIG. 1 shows one example of a conventional liquefied gas storage tank 10 that has upper and lower chambers 11, 12 slanted at about 45 degrees at upper and lower lateral sides of the storage tank 10 to reduce an impact force by sloshing of LNG, particularly, a sloshing impact force in a lateral direction.

For the conventional storage tank 10, the chambers 11, 12 are formed at the upper and lower lateral sides thereof, thereby partially solving problems relating to the sloshing phenomenon. However, as LNG carriers gradually increase in size, the size of the storage tank 10 also increases and the impact force by sloshing becomes severe.

As such, with increasing size of the storage tank, there are demands for solving the problem of an increase in impact force by sloshing and for reinforcing the storage tank to support load of an upper structure of the carrier.

Recently, with gradually increasing demands for floating marine structures such as LNG FPSO (Floating, Production, Storage and Offloading), LNG FSRU (Floating Storage and Regasification Unit) or the like, there is a demand for solving the sloshing problem and the load problem of the upper structure for the liquefied gas storage tanks provided to such floating marine structures.

The LNG FPSO is a floating marine structure that permits direct extraction and liquefaction of natural gas into LNG at sea to store the LNG in the storage tanks thereof and to deliver the LNG stored in the storage tanks to another LNG carrier, as needed. The LNG FSRU is a floating marine structure that permits storage of LNG, discharged from an LNG carrier, in the storage tanks at sea a long distance from land and gasification of the LNG as needed, thereby supplying the regasified LNG to consumers on the land.

Korean Patent No. 0785475 (Hereinafter, Document 1) discloses a storage tank that is provided with a structure (that is, a bulkhead), such as partitions, inside the storage tank to divide an interior space of the storage tank into several spaces, instead of increasing the size of the storage tank, thereby providing the effect of installing several storage tanks each having a small capacity and solving the sloshing problem.

FIGS. 2 and 3 show a storage tank 20 that is disclosed in Document 1 and includes the partition-shaped structure to divide the interior space of the storage tank 20 into two spaces in order to reduce the influence of sloshing.

As shown in FIGS. 2 and 3, the storage tank 20 of Document 1 includes an anti-sloshing bulkhead 23 dividing the interior of the storage tank 20 and stools 25 bonded at one side thereof to an inner wall 21 of a hull and bonded at the other side thereof to the anti-sloshing bulkhead 23 to secure the anti-sloshing bulkhead 23 inside the storage tank.

Each of the stools 25 includes thermal insulation pads 26 connected to primary and secondary barriers 22*a*, 22*b* of the storage tank 20, respectively, to prevent leakage of the cryogenic liquefied gas or heat transfer to the inner wall of the hull.

For the storage tank of Document 1, however, since a single storage tank 20 is divided into several spaces by the anti-sloshing bulkhead 23, there is a problem in that the anti-sloshing bulkhead 23 is not firmly secured inside the storage tank to sufficiently absorb the sloshing impact.

Namely, to allow the partition-shaped structure, that is, the anti-sloshing bulkhead 23, to be firmly secured inside the storage tank 20 so as to absorb the sloshing impact, the stool 25 must be firmly disposed between the anti-sloshing bulkhead 23 and the inner wall 21 of the hull. To this end, the stool 25 is made of a sufficiently thick metal plate or includes a number of connection points with respect to the inner wall 21 of the hull.

In this case, however, there is a high possibility that the amount of heat transferred from an exterior into the storage tank 20 increases, thereby deteriorating thermal insulation performance of the storage tank 20 while generating a great amount of boil-off gas within the storage tank 20.

On the other hand, if the thickness of the metal plate for the stool 25 is decreased or the number of connection points between the stool 25 and the inner wall 21 of the hull is decreased to enhance thermal insulation performance of the storage tank 20, the connection points between the anti-sloshing bulkhead 23 and the stool 25 or the connection points between the stool 25 and the inner wall 21 of the hull can be damaged due to the sloshing impact.

Further, the stools 25 provide discontinuous points on the primary and secondary barriers of the storage tank 20, which cause damage of the primary and secondary barriers by thermal shrinkage or expansion of the storage tank 20.

Moreover, since the anti-sloshing bulkhead 23 is the partition-shaped thin structure, it cannot support load from an upper deck of the marine structure.

SUMMARY

The present disclosure is directed to solving the problems of the conventional technique as described above, and one embodiment includes a liquefied gas storage tank that includes a plurality of liquefied gas storage tanks received in a plurality of spaces defined by a longitudinal cofferdam and arranged in two rows at opposite sides of the longitudinal cofferdam supporting load of an upper structure while suppressing a sloshing phenomenon. Another embodiment provides a marine structure including the same.

In accordance with an aspect, a liquefied gas storage tank received in a marine structure to store a liquefied gas includes a plurality of liquefied gas storage tanks respectively received in a plurality of spaces defined by a cofferdam in a hull of the marine structure to be arranged in two rows inside the marine structure. Here, the cofferdam includes at least one longitudinal cofferdam extending in a longitudinal direction of the hull and at least one transverse cofferdam extending in a transverse direction of the hull, and each of the storage tanks is sealed and thermally insulated by a sealing wall and a thermal insulation wall extending without being disconnected.

A fluid channel may be defined in the cofferdam between two adjacent liquefied gas storage tanks to allow a cargo received in the two adjacent storage tanks to move therebetween through the fluid channel.

The fluid channel may be sealed and thermally insulated to prevent heat transfer from the exterior of the storage tanks.

The fluid channel may penetrate the longitudinal cofferdam to allow the two storage tanks adjacent to each other in a width direction of the marine structure to communicate with each other through the fluid channel.

The fluid channel may include a lower fluid channel defined at a lower portion of the cofferdam to allow the liquefied gas to move between the two adjacent storage tanks.

The lower fluid channel may be defined adjacent to bottoms of the storage tanks.

The fluid channel may include an upper fluid channel defined at an upper portion of the cofferdam to allow boil-off gas to move between the two adjacent storage tanks.

The upper fluid channel may be defined adjacent to the ceilings of the storage tanks.

The longitudinal cofferdam may be connected to a bottom and/or a ceiling of the storage tank substantially in a vertical direction.

The cofferdam may include a pump and a pipe disposed therein to discharge the liquefied gas stored in the storage tanks.

The cofferdam may include a lower fluid channel defined at a lower portion of the cofferdam to allow the liquefied gas stored in two adjacent liquefied gas storage tanks to move therebetween through the lower fluid channel, and the pump may be disposed at an upper portion of the lower fluid channel inside the cofferdam.

The lower fluid channel may be provided therein with a pump to discharge the liquefied gas stored in the storage tanks and the cofferdam may be provided therein with a pipe acting as a discharge passage of the liquefied gas discharged by the pump.

The longitudinal cofferdam may be provided with a cofferdam heater to supply heat into the longitudinal cofferdam.

The cofferdam heater may include a pipe disposed in the longitudinal cofferdam and a pump to transfer a heat exchange medium in the pipe.

The cofferdam heater may further include a heating mechanism to supply heat to the heat exchange medium.

The heating mechanism may be one selected from a heat exchanger, an electrical heater, and a boiler disposed inside the marine structure and requiring cooling.

In accordance with another aspect, a liquefied gas storage tank received in a marine structure to store a liquefied gas includes: a reinforcement structure longitudinally dividing an interior space of the storage tank to reduce an influence of a sloshing phenomenon while supporting load of an upper structure of the marine structure; a fluid channel defined at a lower portion of the reinforcement structure to allow movement of liquefied gas therethrough; and a sealing wall and a thermal insulation wall extending without being disconnected. Here, the reinforcement structure includes a void defined therein.

The reinforcement structure may be a projection wall protruding to a predetermined height from a bottom of the storage tank.

In accordance with a further aspect, a marine structure used in a floating state at sea and having a storage tank for storing a liquid cargo in a cryogenic state includes cofferdams disposed in longitudinal and transverse directions inside the marine structure to divide an interior space of a hull of the marine structure into a plurality of spaces; and a plurality of the storage tanks received in the respective spaces and arranged in two rows.

The marine structure may be one selected from an LNG FPSO, an LNG FSRU, an LNG carrier, and an LNG RV.

DETAILED DESCRIPTION OF ILLUSTRATIVE EMBODIMENTS

Hereinafter, exemplary embodiments of the present disclosure will be described in detail with reference to the accompanying drawings.

Herein, the term "marine structure" refers to any structure or vessel that includes a storage tank for storing a liquid cargo such as LNG in a cryogenic state and is used in a floating state at sea. For example, the marine structure includes not only floating structures such as LNG FPSO or LNG FSRU, but also vessels such as LNG carries or LNG RV (Regasification Vessel).

Figure 1:
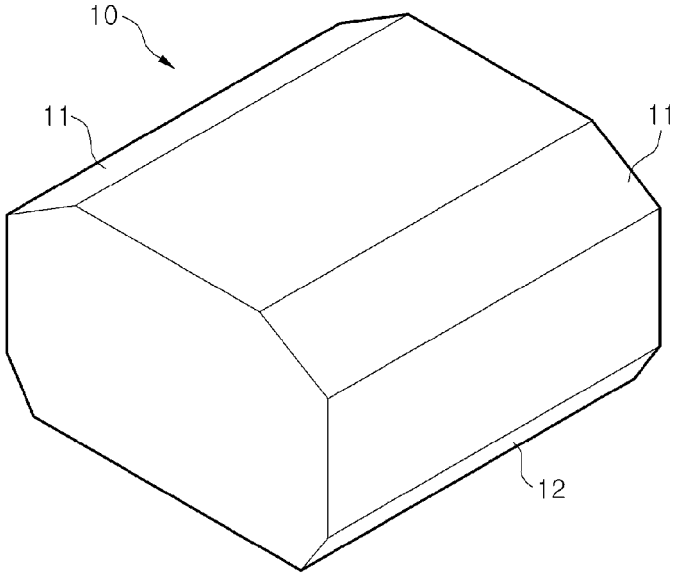
FIG. 1 is a perspective view of a conventional liquefied gas storage tank.
Figure 2:
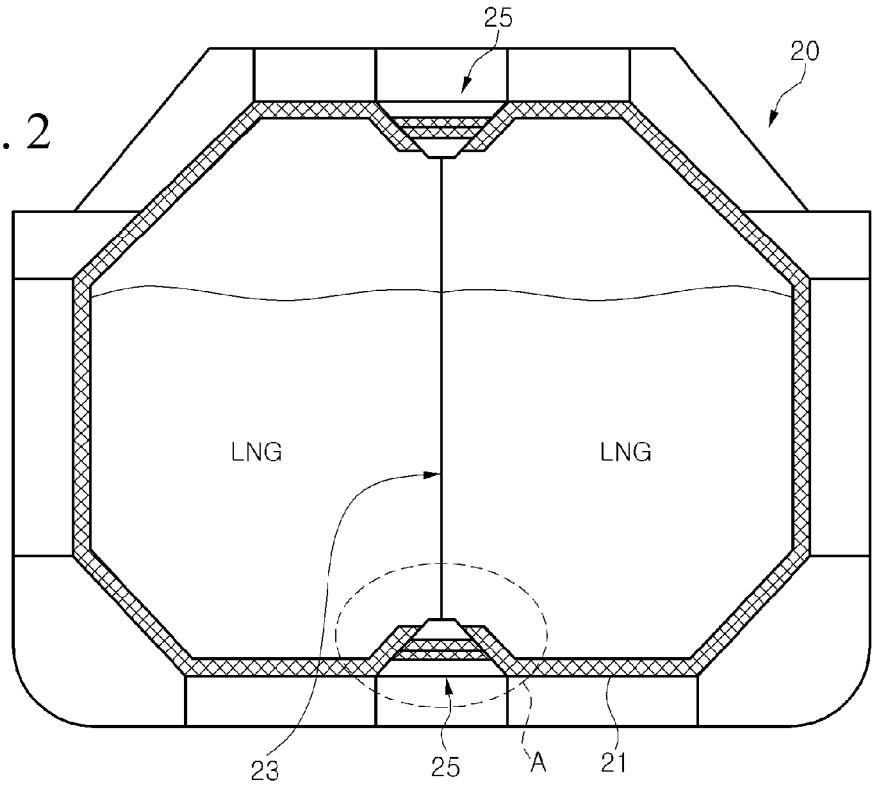
Prior Art Fig. 2
FIG. 2 is a transversely cross-sectional view of the conventional liquefied gas storage tank.
Figure 3:
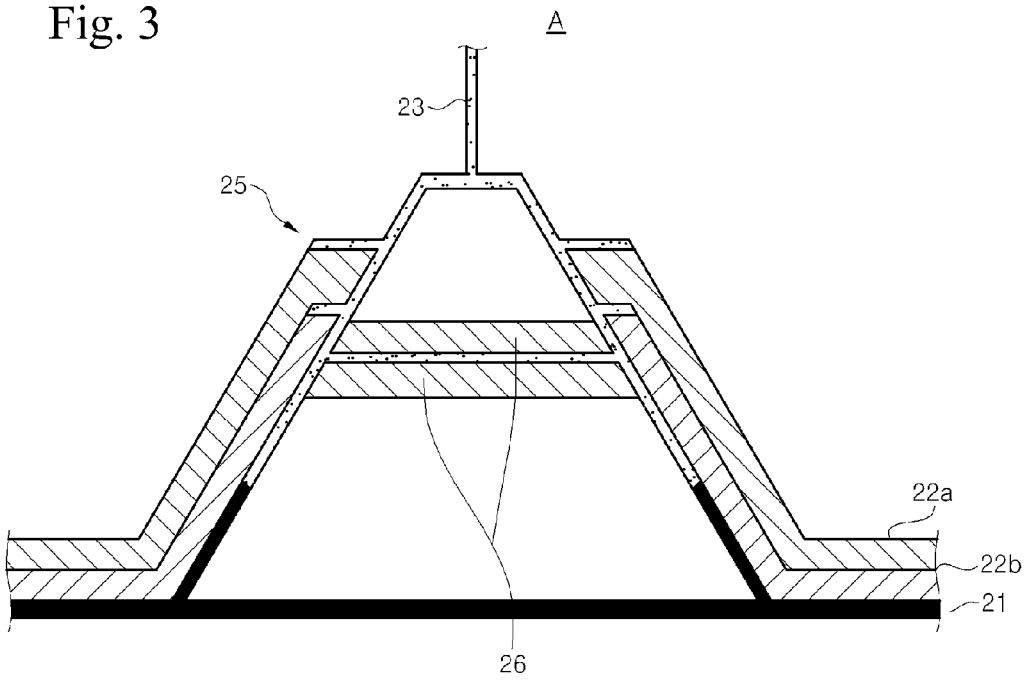
FIG. 3 is an enlarged view of part A of FIG. 2.
Figure 4:
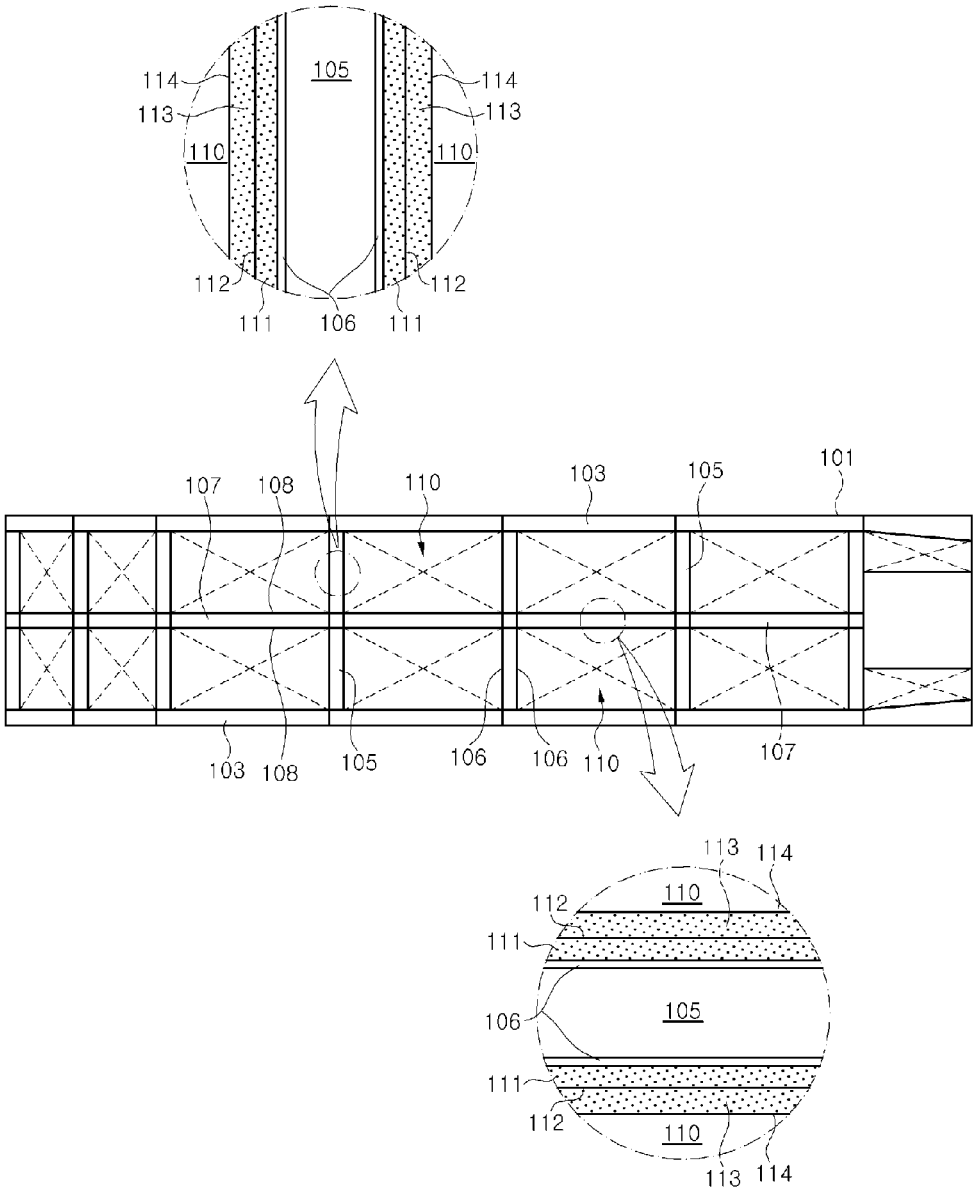
FIG. 4 is a schematic plan view of a marine structure including liquefied gas storage tanks in accordance with a first embodiment of the present disclosure.
Figure 5:
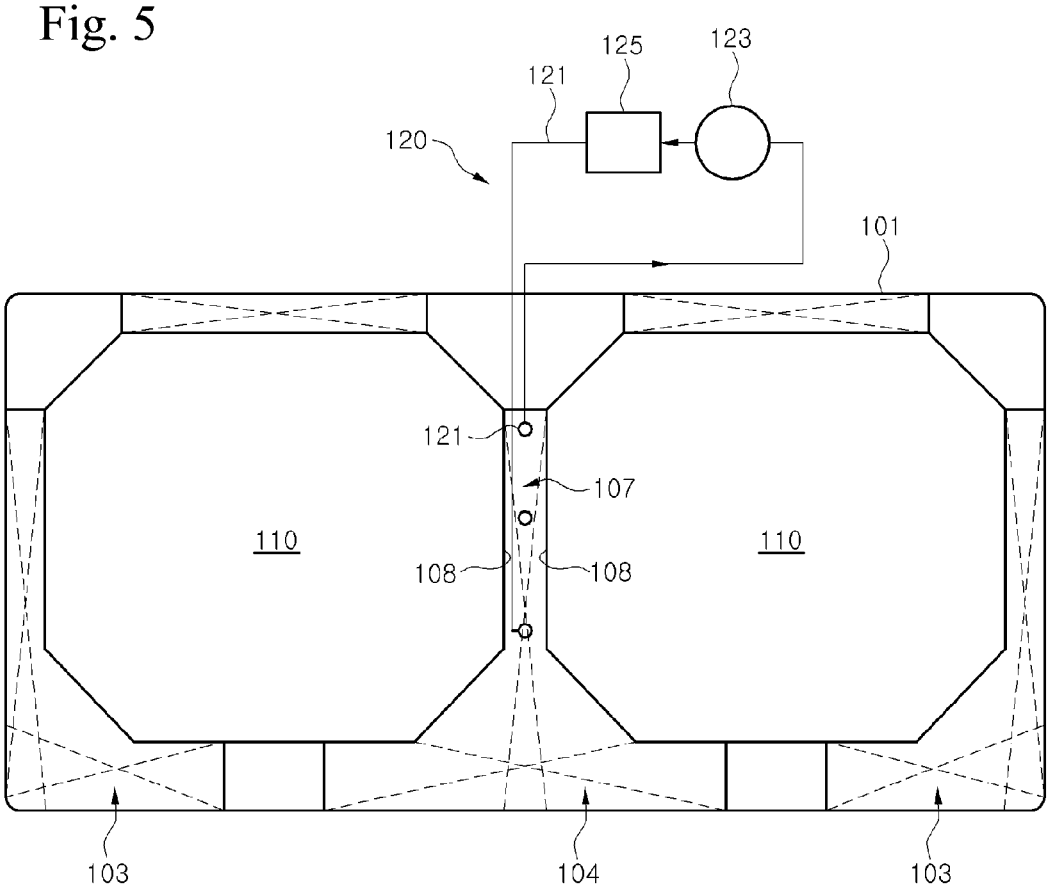
FIG. 5 is a transversely cross-sectional view of the marine structure including the liquefied gas storage tanks in accordance with the first embodiment of the present disclosure.

FIG. 4 is a schematic plan view of a marine structure including liquefied gas storage tanks in accordance with a first embodiment of the present disclosure, and FIG. 5 is a transversely cross-sectional view of the marine structure including the liquefied gas storage tank in accordance with the first embodiment of the present disclosure.

Referring to FIGS. 4 and 5, a liquefied gas storage tank 110 according to the first embodiment includes a plurality of storage tanks arranged in two rows and received in a plurality of spaces that are defined in a hull 101 of the marine structure by a transverse cofferdam 105 disposed in a transverse direction inside the marine structure and a longitudinal cofferdam 107 disposed in a longitudinal direction inside the marine structure.

A combination of the transverse cofferdam 105 and the longitudinal cofferdam 107 provides at least two complete storage spaces, each of which is provided with a thermal insulation wall and a sealing wall extending without being disconnected. In other words, according to this embodiment, the interior space of the marine structure is divided into a plurality of spaces in the transverse and longitudinal directions such that an individual storage tank is received in each space, instead of dividing the interior of the storage tank into two spaces.

As shown in FIG. 4, the membrane type liquefied gas storage tank 110 for storing a liquefied gas such as LNG and the like includes a secondary insulation wall 111, a secondary sealing wall 112, a primary insulation wall 113, and a primary sealing wall 114, which are sequentially stacked on an inner wall or cofferdam partitions 106, 108 in the hull 101 of the marine structure. The hull 101 is provided with a ballast tank 103 to maintain the draft of the marine structure.

Herein, the term "cofferdam" refers to a lattice-shaped structure defined in a void between the cofferdam partitions (bulkheads) 106, 108 and divides the interior space of the marine structure into a plurality of spaces in the longitudinal and transverse directions to allow the membrane-type storage tanks to be received in the respective spaces.

In the embodiment, the cofferdams include transverse cofferdams 105 and the longitudinal cofferdams 107. The transverse cofferdams 105 divide the interior space of the hull into a plurality of spaces in the transverse direction to allow the membrane type storage tanks to be respectively received in the spaces in the longitudinal direction. The longitudinal cofferdam 105 divides the interior space of the hull into two spaces in the longitudinal direction to allow the membrane type storage tanks to be respectively received in the spaces in the width direction. The transverse cofferdams 105 may constitute a front wall and a rear wall of the liquefied gas storage tank, and the longitudinal cofferdams 107 may constitute a left or right wall of the storage tank.

According to this embodiment, since the storage tank is a membrane type storage tank, the cofferdams described above are used to divide the internal space of the marine structure. For the independent type storage tank, simple partitions may be used to divide the internal space of the marine structure. Since the partitions for the independent type storage tank do not have sufficient strength to support load of an upper structure, it is necessary for the partitions to have a considerable thickness so as to have a sufficient strength to support the load of the upper structure. However, since an expensive material is used for the independent type storage tank, manufacturing costs are significantly increased to fabricate such thick partitions, thereby lowering price competitiveness.

Although tank arrangement such as two-row or more arrangement is well known in the field of oil-tankers, bulk carriers, and the like, such tank arrangement is provided without considering sloshing or thermal deformation and can be obtained merely by installing one or more partitions inside a tank.

In the liquefied gas storage tank for storing and transporting LNG which is a liquid cargo in a cryogenic state, the two-row arrangement can be obtained by newly designing the shape of the storage tank.

In the membrane-type storage tank, membrane members per se, that is, sealing walls and thermal insulation walls, cannot constitute the partitions, and if non-ferrous metal partitions are used in the conventional membrane type storage tank, manufacturing costs of the storage tank are increased due to high prices of the non-ferrous metal. Further, when the non-ferrous metal partitions are installed in the membrane type storage tank, it is necessary to provide a special design in consideration of installation of the partitions. Moreover, the interior of the storage tank cannot be completely surrounded by a single membrane structure and a discontinuous point is formed between the membrane structure and the partition, thereby causing possibility of damage at a connection point between the membrane structure and the partition.

The inventors of the present disclosure suggest a two-row arrangement of membrane-type storage tanks that are paired in the width direction of the marine structure and arranged in two rows in the longitudinal direction inside the marine structure by providing the longitudinal cofferdams 107 extending in the longitudinal direction and the transverse cofferdams 105 extending in the transverse direction within the hull 101 of the marine structure, as shown in FIG. 4.

The longitudinal cofferdam 107 defines a void between the storage tanks which are arranged in two rows. In other words, the storage tanks are arranged at opposite sides of the void to provide two rows of storage tanks and can guarantee individual storage spaces, each of which is completely sealed by the membrane members.

According to this embodiment, a membrane type storage tank, a cofferdam, and another membrane type storage tank are sequentially arranged in the width direction of the marine structure, as shown in FIG. 5. As a result, the two-row arrangement of storage tanks can be formed by application of an existing verified technology (that is, the transverse cofferdam) for the membrane type storage tanks, while the longitudinal cofferdam 107 disposed between the membrane type storage tanks serves to support the load of the upper structure.

The present invention can be applied not only to the membrane type storage tank, but also to an SPB type storage tank. When the invention is applied to the SPB type storage tank, the cofferdams may be provided to the interior space of the SPB type storage tank or the interior space of the hull of the marine structure for installing the SPB type storage tank, instead of merely installing the partitions inside the SPB type storage tank.

When the liquefied gas storage tanks 110 are arranged in two rows, an impact force exerted on the storage tanks by sloshing can be significantly reduced. Numerical analysis shows that the sloshing impact force is reduced by the following two mechanisms. First, the amount of cargo, i.e. LNG, stored in each of the storage tanks, is decreased, thereby reducing the impact force by sloshing. Second, the width of the storage tank is reduced to half or more that of the conventional storage tank, so that the natural frequency of motion of the liquid cargo, that is, LNG, becomes different from that of the marine structure, thereby reducing the magnitude of motion of the liquid cargo.

Further, a floating structure such as LNG FPSO and the like has a heavy upper structure and needs a storage tank that can sustain a heavy load of the upper structure. According to this embodiment, the two-rows of storage tanks 110 are provided by disposing the longitudinal cofferdam 107 between the membrane type storage tanks 110 instead of dividing the tank into two parts using a thin partition, so that the longitudinal cofferdam 107 can serve to support and distribute the load of the upper structure.

The design of supporting the upper load by disposing the cofferdam 107 at the middle of the marine structure cannot be found in the conventional membrane type tank, Moss type tanks, SPB type tank, and the like. Although the SPB type tank includes the central partition as described above, the central partition must have a considerable thickness to sustain the upper load. In this case, since manufacturing costs increase significantly, it is impractical to use the central partition to support the weight of the upper structure.

On the other hand, although the inner wall of the hull 101 and the cofferdam partitions 106, 108 do not directly contact the liquefied gas stored in the storage tank, the liquefied gas, that is, LNG, is stored in a cryogenic state at a temperature of −163° in the liquefied gas storage tank 110, so that the temperature of iron plates constituting the inner wall of the hull 101 and the cofferdam partitions 106, 108 is significantly lowered due to heat transfer to the cryogenic liquefied gas and is deteriorated in brittleness. Accordingly, the inner wall of the hull 101 and the cofferdam partitions 106, 108 may be made of a low temperature steel having resistance to low temperatures.

The cofferdam located between the storage tanks 110, specifically, the longitudinal cofferdam 107, is a closed inner space, to which heat is not supplied from the outside of the storage tanks, so that the temperature of the longitudinal cofferdam 107 can be decreased to about −60°. Accordingly, there is a need to heat the inner space of the longitudinal cofferdam 107 and the longitudinal cofferdam partitions 108 so as to maintain them at a predetermined temperature or more.

As shown in FIG. 5, the space between the longitudinal cofferdam partitions 108, that is, the longitudinal cofferdam 107, may be used as part of a central ballast tank 104.

According to this embodiment, a cofferdam heater 120 may be disposed inside the longitudinal cofferdam 107. The cofferdam heater 120 may include a pipe 121 disposed inside the longitudinal cofferdam 107, a pump 123 circulating a heat exchange medium through the pipe 121, and a heating mechanism 125 heating the heat exchange medium cooled within the longitudinal cofferdam 107.

The pipe 121 of the cofferdam heater 120 may constitute a closed loop, and the pump 123 and the heating mechanism 125 may be located outside the longitudinal cofferdam 107. The heating mechanism may be a heat exchanger, an electric heater, a boiler or the like, which can be disposed inside the marine structure and cooled as needed.

The heat exchange medium may heat the interior of the longitudinal cofferdam 107 by transferring heat to air or ballast water surrounding the pipe 121 while passing through the pipe 121 disposed inside the longitudinal cofferdam 107.

The cofferdam heater 120 may include at least one closed loop. For the pipe 121 having one or more closed loop, if one of the closed loops is non-operative or does not transfer a sufficient amount of heat into the longitudinal cofferdam 107, another closed loop may be advantageously used to heat the interior of the longitudinal cofferdam 107.

The pipe 121 of the cofferdam heater 120 may be arranged in an open-loop shape and may be provided therein with an anti-freezing solution, freshwater, seawater or the like as the heat exchange medium circulating therein.

When seawater is supplied through the pipe 121 arranged in the open-loop shape, heat may be supplied into the longitudinal cofferdam 107 by supplying the seawater into the longitudinal cofferdam 107 through the pipe 121 without additionally supplying heat to the seawater depending on the temperature of the seawater.

Although the pipe 121 is shown as being arranged in three rows inside the longitudinal cofferdam 107 in FIG. 5, the number and arrangement of the pipes 121 inside the longitudinal cofferdam 107 may be variously modified according to designs.

Figure 6:
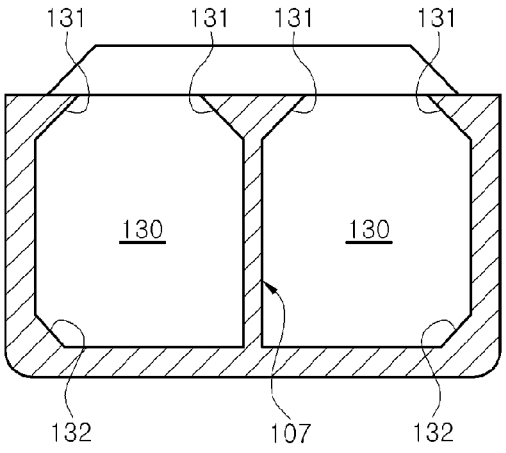
FIG. 6 is a transversely cross-sectional view of liquefied gas storage tanks in accordance with a modification of the first embodiment.
Figure 7:
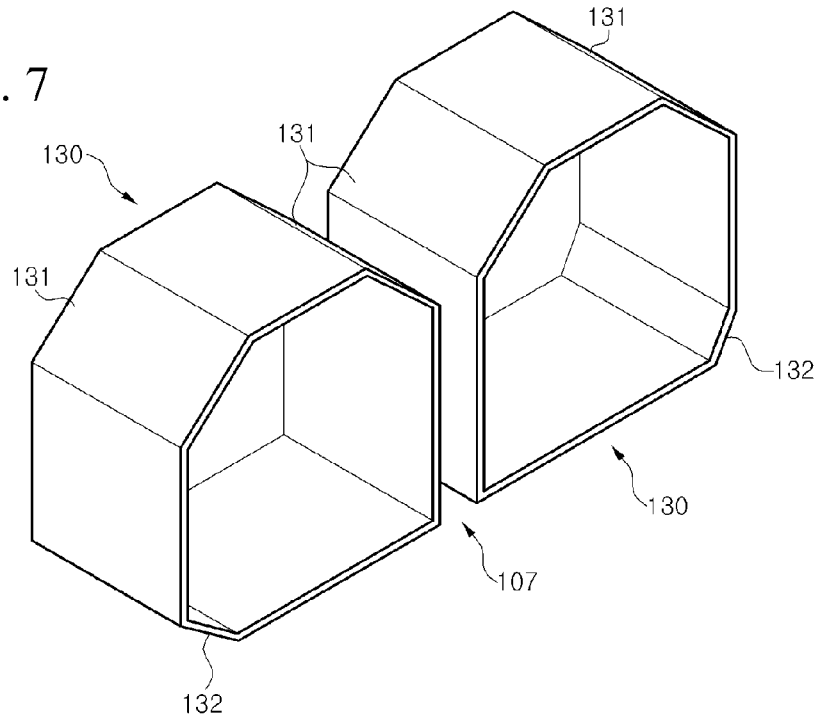
FIG. 7 is a partially cutaway perspective view of the liquefied gas storage tanks in accordance with the modification of the first embodiment.

FIG. 6 is a transversely cross-sectional view of a marine structure including liquefied gas storage tanks in accordance with a modification of the first embodiment, and FIG. 7 is a partially cutaway perspective view of the liquefied gas storage tanks in accordance with the modification of the first embodiment.

Referring to FIGS. 6 and 7, a liquefied gas storage tank 130 according to the modification of the first embodiment includes a plurality of liquefied gas storage tanks 130 that are arranged in two rows in the longitudinal direction of the hull 101 along the longitudinal cofferdam 107, which is disposed to divide the interior space of the marine structure in the longitudinal direction in order to reduce an influence by sloshing of LNG stored in the storage tanks 130 while supporting the load of the upper structure.

In this modification, as shown in FIGS. 5 and 6, the longitudinal cofferdam 107 is not formed at a lower portion thereof with a chamfer in order to allow the storage tanks to be arranged in two rows while guaranteeing storage capacity. The numerical analysis shows that the storage tanks 130 having the two-row arrangement can endure sloshing impact without the formation of the chamfer at the lower portion of the longitudinal cofferdam 107.

Figure 8:
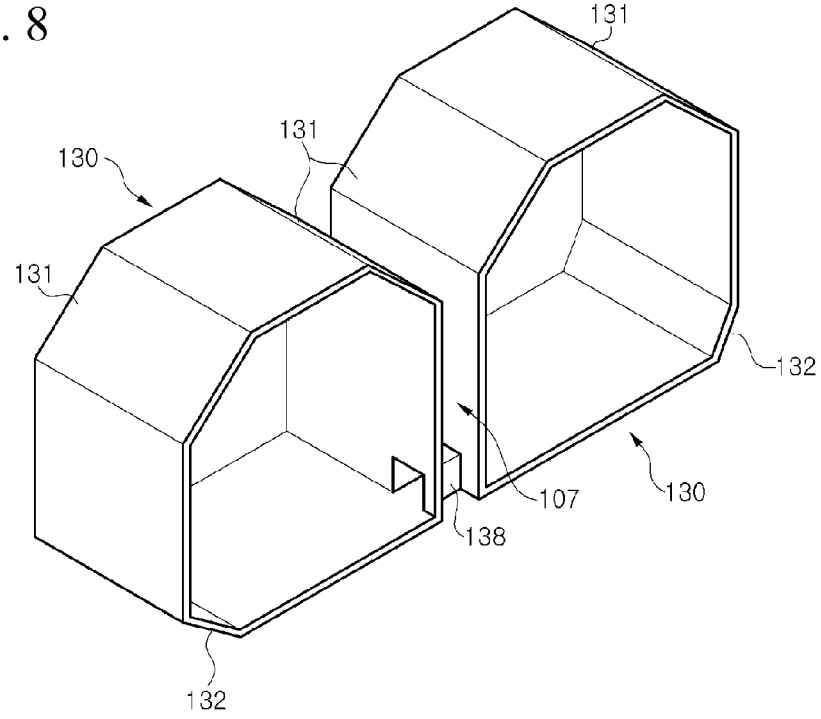
FIG. 8 is a partially cutaway perspective view of liquefied gas storage tanks in accordance with another modification of the first embodiment.

FIG. 8 is a partially cutaway perspective view of liquefied gas storage tanks in accordance with another modification of the first embodiment.

In this modification, a liquefied gas storage tank 130 is formed at a lower portion thereof with a fluid channel 138, that is, a lower fluid channel, which is not provided to the storage tank 130 shown in FIGS. 6 and 7. In other words, the storage tank 130 of this modification has upper chamfers 131 formed at an inward upper end thereof with reference to a transverse cross-section of the marine structure, that is, at an upper end of the longitudinal cofferdam 107, and at an outward upper end of the storage tank 130 with reference to the transverse cross-section of the marine structure. Further, the storage tank 130 of this modification has a lower chamfer 132 formed at an outward lower end thereof with reference to the transverse cross-section of the marine structure excluding an inward lower end of the storage tank, that is, a lower end of the longitudinal cofferdam 107.

According to this modification, the lower fluid channel 138 allows the liquid gas storage tanks 130 constituting each pair in the two-row arrangement to communicate with each other such that the liquefied gas moves from one storage tank to the other storage tank or vice versa therethrough.

As such, since the lower fluid channel 138 allows the liquefied gas to move between the storage tanks 130, all of the liquid cargo can be discharged from both storage tanks 130 even in the case where equipment such as a pump, pipe, and pump tower for discharging the liquid cargo from the storage tanks 130 is installed to one of both storage tanks 130. For this purpose, the lower fluid channel 138 may be formed adjacent to the lowermost portion of the longitudinal cofferdam 107, that is, to the bottoms of the storage tanks 130.

In this embodiment, since the lower fluid channel 138 is formed in the longitudinal cofferdam 107 to be at a right angle to the bottom of the storage tank without forming the chamfer at the lower end of the longitudinal cofferdam 107, it can be more easily formed than the case where the chamfer is formed at the lower end of the longitudinal cofferdam 107 for the following reasons.

When fabricating the membrane type storage tank, a parallelepiped heat-insulating box is assembled to a predetermined size. Particularly, heat-insulating boxes corresponding to the corners of the storage tank are separately manufactured and assembled to form the storage tank.

To form the lower fluid channel in the cofferdam using a tank having a lower chamfer formed at the lower end of the cofferdam, the fluid channel must be formed to penetrate the lower chamfer of the cofferdam.

As such, when forming the lower fluid channel penetrating the lower chamfer, it is necessary to fabricate a new type of heat-insulating boxes that do not exist in the art. Manufacturing such a new type of heat-insulating boxes is more difficult and consumes more time than manufacturing flat heat-insulating boxes, thereby increasing manufacturing costs. In other words, there is difficulty that the new type of large heat-insulating boxes must be manually fabricated so as to form the fluid channel penetrating the lower chamfer and that a complicated welding process must be performed to join the fabricated heat-insulating boxes to each other.

As suggested in the modification described above, however, when the longitudinal cofferdam 107 is not formed at the lower end thereof with the chamfer but is connected substantially at a right angle to the bottom of the storage tank, the storage tank according to the modification has a simpler shape than the storage tank having the chamfer at the lower end of the longitudinal cofferdam and does not have a sloped surface, so that the storage tank can be fabricated using a method, tools and techniques for the conventional heat-insulating boxes, thereby improving productivity.

On the other hand, the number and shape of the lower fluid channels 138 do not limit the invention and may be appropriately modified in consideration of the size of the storage tank 130 and the like. Further, the lower fluid channel 138 may be formed not only in the longitudinal cofferdam 107 but also in the transverse cofferdam 105.

Further, the lower fluid channel 138 may be thermally insulated to prevent heat transfer from the exterior of the storage tank 130. In this case, any heat-insulating method currently applied to the membrane type storage tank or the independent type storage tank may be used.

As described above, according to this modification, the longitudinal cofferdam is provided to the marine structure to suppress the sloshing phenomenon and support the load of the upper structure of the marine structure, so that the interior space of the marine structure is divided into two spaces by the longitudinal cofferdam and two rows of storage tanks are received in the divided spaces inside the marine structure. Even in this case, however, the storage tanks can be efficiently operated by providing each pair of storage tanks with equipment including a pump, a pipe, a pump tower and a gas dome for discharging the liquefied gas and boil-off gas to the outside. Accordingly, manufacturing costs of the liquefied gas storage tanks can be reduced and operation and management of the storage tanks can be easily carried out.

Figure 9:
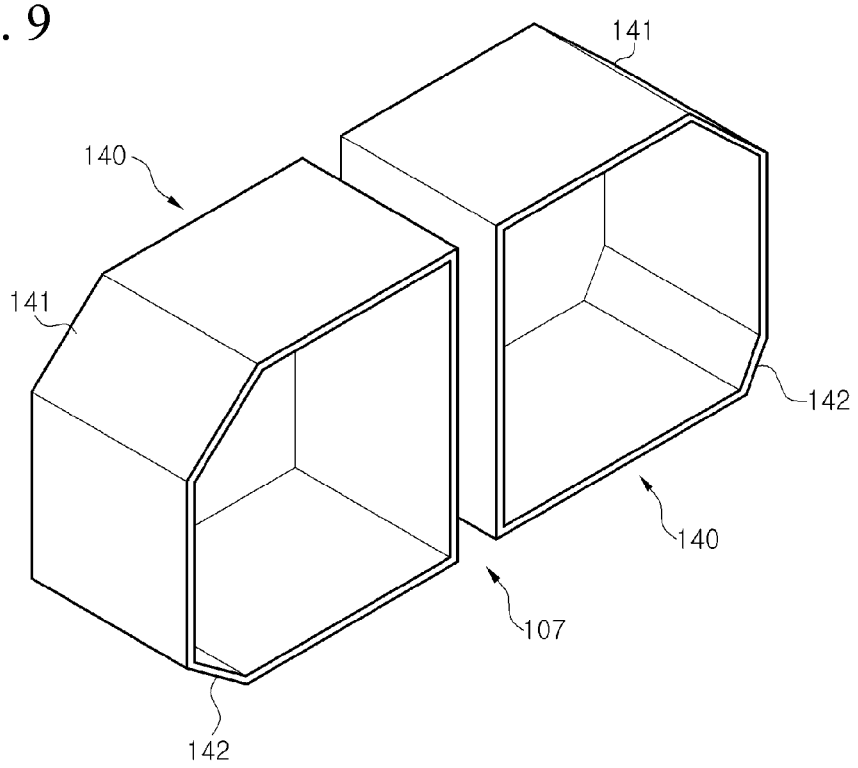
FIG. 9 is a partially cutaway perspective view of liquefied gas storage tanks in accordance with a further modification of the first embodiment.

FIG. 9 is a partially cutaway perspective view of liquefied gas storage tanks in accordance with a further modification of the first embodiment. In a liquefied gas storage tank 140 of this modification, a chamfer is not formed at both upper and lower ends of the longitudinal cofferdam 107.

This structure may be employed for storage tanks which can be less influenced by sloshing in consideration of marine conditions.

Further, although not shown in the drawings, the storage tank 140 of FIG. 9 may also be formed with a fluid channel that penetrates the cofferdam. The fluid channel may be formed not only in the longitudinal cofferdam but also in the transverse cofferdam.

Figure 10:
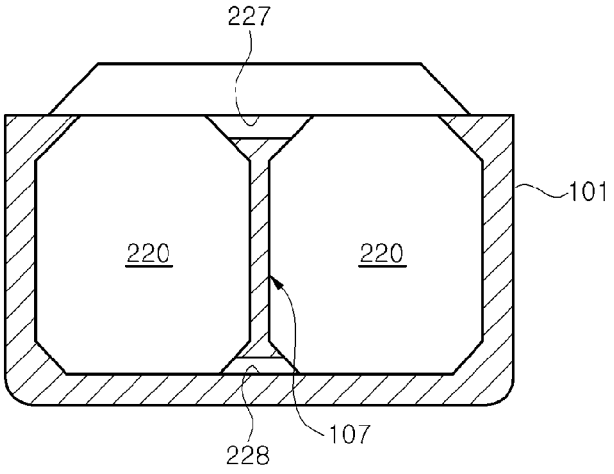
FIG. 10 is a transversely cross-sectional view of a marine structure including liquefied gas storage tanks in accordance with a second embodiment of the present disclosure.
Figure 11:
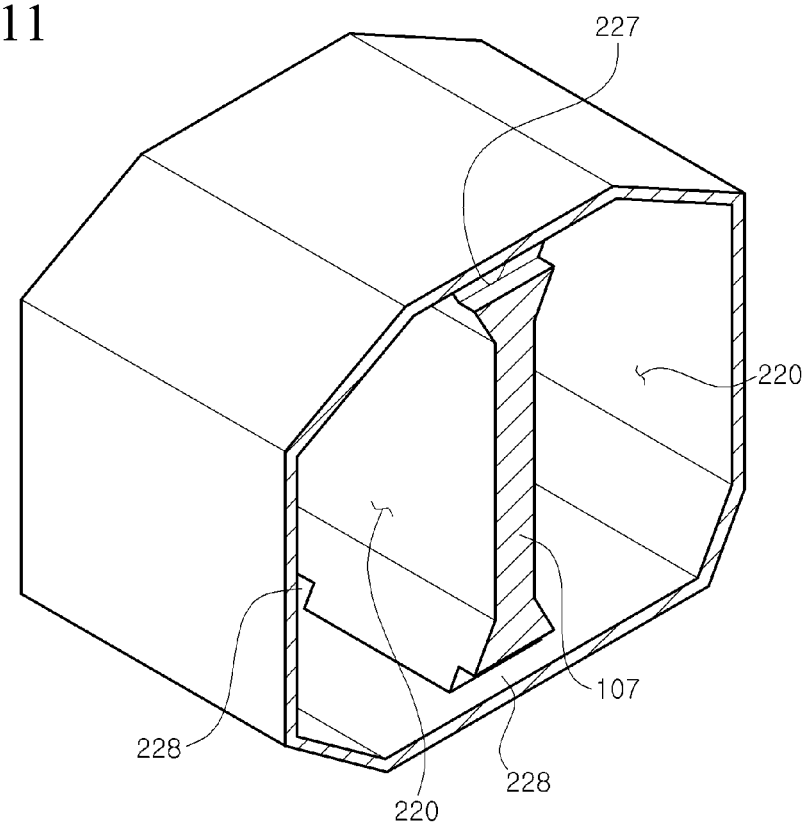
FIG. 11 is a partially cutaway perspective view of the liquefied gas storage tanks in accordance with the second embodiment of the present disclosure.

FIG. 10 is a transversely cross-sectional view of a marine structure including liquefied gas storage tanks in accordance with a second embodiment of the present disclosure, and FIG. 11 is a partially cutaway perspective view of the liquefied gas storage tanks in accordance with the second embodiment.

Referring to FIGS. 10 and 11, a liquefied gas storage tank 220 according to the second embodiment includes a plurality of storage tanks 220 longitudinally arranged in two rows along a longitudinal cofferdam 107, which divides an interior space of the hull 101 of the marine structure into two spaces to reduce an influence by the sloshing phenomenon of a liquefied gas in the storage tanks.

According to this embodiment, the longitudinal cofferdam 107 is formed at upper and lower portions thereof with at least one upper fluid channel 227 and at least one lower fluid channel 228. The upper and lower fluid channels 227, 228 allow two liquefied gas storage tanks 220 adjacent to each other in the width direction to communicate with each other.

The upper fluid channel 227 allows discharge of boil-off gas (BOG), which is naturally generated during transportation of a liquefied gas, and the lower fluid channel 228 allows discharge of the liquefied gas.

According to this embodiment, the BOG can move between the two adjacent storage tanks 220 through the upper fluid channel 227. Even in the case where only one of the two adjacent storage tanks 220 is provided with equipment such as a gas dome (not shown) for discharging the BOG to the outside by an internal pressure of the storage tanks 220 or by other reasons, the upper fluid channel 227 may be formed adjacent to the uppermost portion of the longitudinal cofferdam 107, that is, to the ceilings of the storage tanks 220 in order to allow all of the BOG to be discharged from the two adjacent storage tanks 220.

Further, according to this embodiment, the liquefied gas can move between the two adjacent storage tanks 220 through the lower fluid channel 228. Even in the case where only one of the two adjacent storage tanks 220 is provided with equipment including a pump and a pump tower for discharging the liquefied gas to the outside from the storage tanks 220, the lower fluid channel 228 may be formed adjacent to the lowermost portion of the longitudinal cofferdam 107, that is, to the bottoms of the storage gas tanks 220 in order to allow all of the liquefied gas to be discharged from the two adjacent storage tanks 220.

The number and shape of the upper and lower fluid channels 227, 228 do not limit the invention and may be appropriately modified in consideration of the size of the storage tank 220 and the like.

Further, the upper and lower fluid channels 227, 228 may be thermally insulated to prevent heat transfer from the exterior of the storage tank 220. In this case, any heat-insulating method currently applied to the membrane type storage tank or the independent type storage tank may be used.

Figure 12:
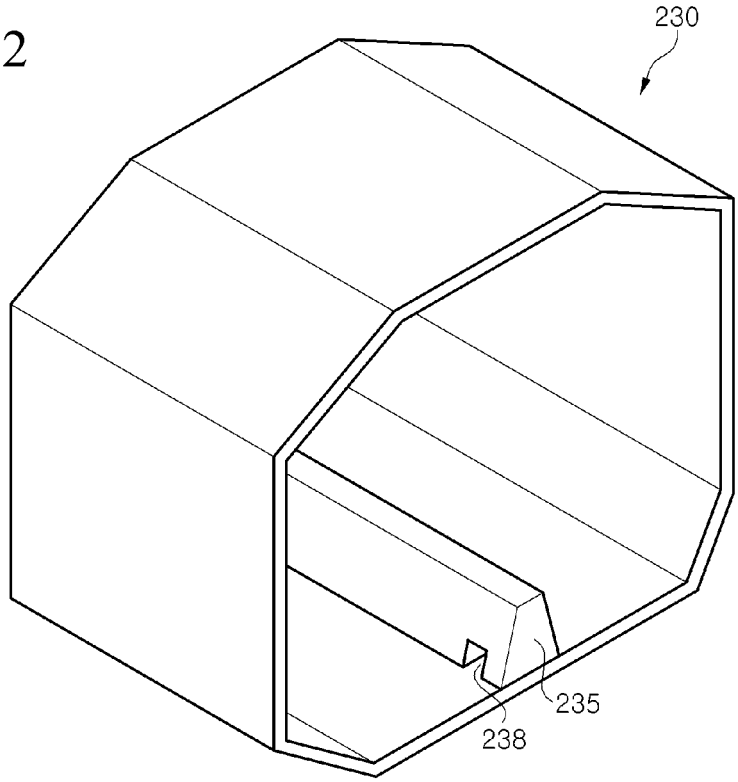
FIG. 12 is a partially cutaway perspective view of a storage tank in accordance with a modification of the second embodiment of the present disclosure.

FIG. 12 is a partially cutaway perspective view of a storage tank in accordance with a modification of the second embodiment.

Referring to FIG. 12, a liquefied gas storage tank 230 according to the modification of the second embodiment includes a projection wall 235 protruding to a predetermined height from an inner bottom of the storage tank 230 to reduce an influence by the sloshing phenomenon of LNG stored therein.

In the second embodiment described above, the longitudinal cofferdam 107 is formed from the bottom of the storage tank to the ceiling thereof to completely divide the interior space of the hull 101. On the contrary, in the storage tank 230 of this modification, the projection wall 235 protrudes to a predetermined height from the bottom of the storage tank to divide a lower space of the storage tank without dividing an upper space thereof.

Unlike the partition formed separately from the liquefied gas storage tank, the projection wall 235 may be integrally formed with the storage tank 230 by deforming the shape thereof. In other words, a thermal insulation wall and a sealing wall of the storage tank 230 extend without being disconnected at the partition wall 235 to define a completely sealed storage space in the storage tank 230.

The projection wall 235 may have any height so long as it can achieve effective reduction of the influence by the sloshing phenomenon.

In this modification, the projection wall 235 is formed at a lower portion thereof with at least one lower fluid channel 238. The lower fluid channel 238 allows the liquefied gas to flow between both divided spaces of the storage tank 230.

As described above, according to the second embodiment, the reinforcement structure, such as the cofferdam or the projection wall, is provided to the marine structure to suppress the sloshing phenomenon, so that the interior space of the hull is divided into two spaces by the projection wall to receive two rows of storage tanks in the respective spaces inside the marine structure. Even in this case, however, the storage tank can be efficiently operated by providing each pair of storage tanks with equipment including a pump, a pump tower, and a gas dome for discharging the liquefied gas and boil-off gas to the outside. Accordingly, manufacturing costs of the liquefied gas storage tanks can be reduced and operation and management of the storage tanks can be easily carried out.

Figure 13:
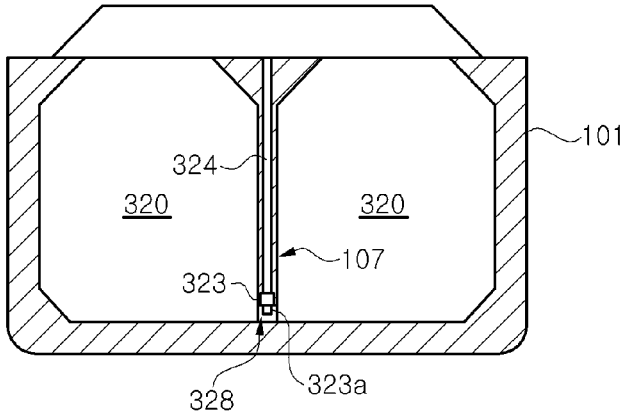
FIG. 13 is a transversely cross-sectional view of a marine structure including liquefied gas storage tanks in accordance with a third embodiment of the present disclosure.
Figure 14:
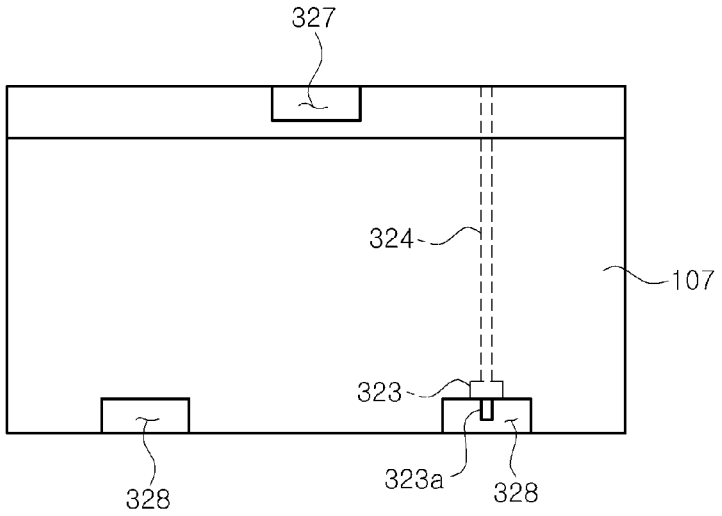
FIG. 14 is a longitudinally cross-sectional view of the liquefied gas storage tank in accordance with the third embodiment of the present disclosure.
Figure 15A:
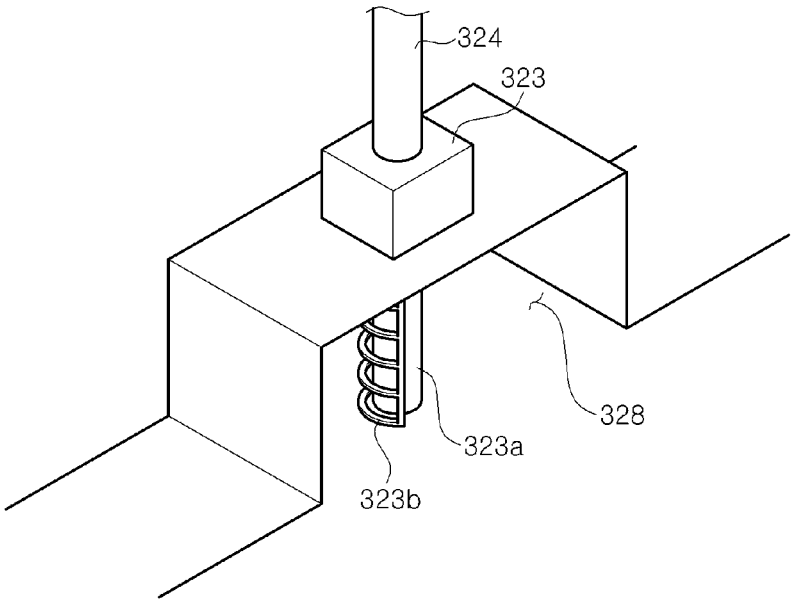
FIGS. 15A and 15B show a pump and a pipe disposed in the storage tank.
Figure 15B:
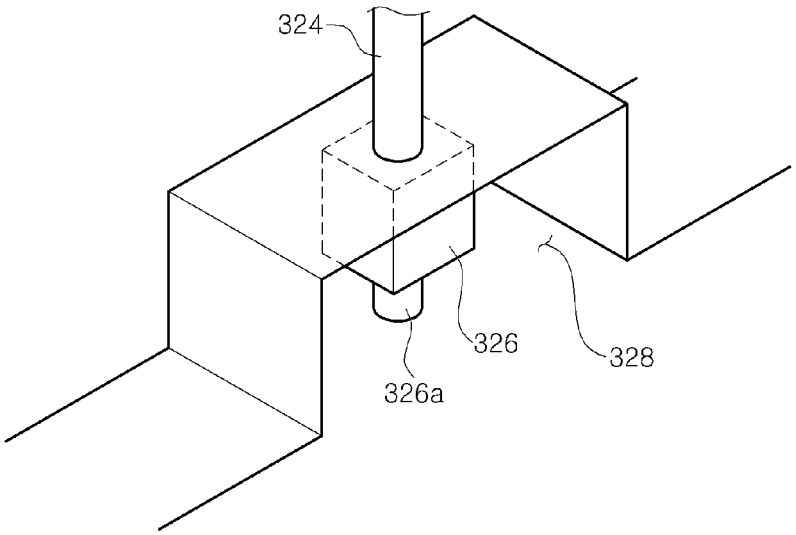

FIG. 13 is a transversely cross-sectional view of a marine structure including liquefied gas storage tanks in accordance with a third embodiment of the present disclosure, and FIG. 14 is a longitudinally cross-sectional view of the liquefied gas storage tank in accordance with the third embodiment. Further, FIGS. 15A and 15B illustrate a pump and a pipe in the storage tank in accordance with the third embodiment.

Referring to FIGS. 13 and 14, a liquefied gas storage tank 320 according to the third embodiment includes a plurality of storage tanks 320 arranged in two rows along a longitudinal cofferdam 107, which divides an interior space of the marine structure into two spaces to reduce an influence of the sloshing phenomenon of LNG stored in the storage tanks.

Although the storage tank 320 is shown as not including the chamfer at the lower end of the reinforcement structure, that is, the longitudinal cofferdam 107 in FIG. 13, it should be understood that the storage tank 320 may also have the chamfer at the lower end of the longitudinal cofferdam 107. Further, although not shown in FIG. 13, the chamfer may not be formed at the upper end of the longitudinal cofferdam 107 in the case where an influence of the sloshing phenomenon is not severe depending on the marine conditions.

According to the third embodiment, the longitudinal cofferdam 107 is formed at a lower portion thereof with at least one lower fluid channel 328, which is provided at an upper side thereof with a pump 323 and a pipe 324 to discharge the liquefied gas to the outside of the storage tanks.

In this embodiment, since the pipe 324 is formed in the longitudinal cofferdam 107, there is no need for installing a separate pump tower or the like inside the storage tank to maintain and reinforce the pipe 324.

The longitudinal cofferdam 107 may be formed at an upper portion thereof with at least one upper fluid channel 327.

The number and shape of the upper and lower fluid channels 327, 328 do not limit the invention and may be appropriately modified in consideration of the size of the storage tank 320 and the like.

According to the third embodiment, the pump 323 or 326 and the pipe 324 are disposed at the upper side of the lower fluid channel 328. Although not shown in the drawings, the lower fluid channel 328 may be further provided at the upper side thereof with a variety of valves associated with the pump 323 or 326 and the pipe 324, and with other pipes (not shown), such as a discharge pipe, a filling pipe, and the like, for loading LNG to the storage tanks or discharging the LNG therefrom or for supplying LNG to various devices such as a regasification device, a propeller and the like.

Although detailed descriptions of the number or positions of various pipes and valves provided to a general liquefied gas storage tank are omitted herein for convenience of description, it should be considered that the term "pipe" refers to all of the pipes and valves described above.

Referring to FIGS. 13, 14 and 15A, the pump 323 may be disposed on the upper side of the lower fluid channel 328, specifically, on top of the ceiling of the lower fluid channel 328. The pump 323 is provided at an upper side thereof with the pipe 324, through which the liquefied gas is discharged to the outside, and at a lower side thereof with a suction pipe 323*a* extending from the pump 323. The pump 323 and the pipe 324 may be located within the longitudinal cofferdam 107, thereby eliminating a need for a separate structure such as a pump tower inside the storage tank to maintain and reinforce the pump 323 and the pipe 324.

When reinforcing the suction pipe 323*a* extending from the pump 323, a conventional reinforcement structure for the pump tower or other type reinforcement structures may be provided to the suction pipe 323*a*.

An access member 323*b* such as a ladder or the like may be disposed in the lower fluid channel 328 to access the interior of the storage tank. Although the access member 323*b* is shown as being provided to the suction pipe 323*a* in FIG. 15A, the invention is not limited thereto. The installation position of the access member 323*b* may be changed so long as an operator can access the interior of the lower fluid channel 328 and the interior of the storage tank 320 via the access member 323*b*.

The access member 323*b* is adapted to allow an operator to access the storage tank to perform an operation, for example, an operation for checking leakage from the membrane type storage tank, and it should be understood that a detailed shape or installation method thereof do not limit the invention. Furthermore, the access member 323*b* may be extended along the pipe 324 to the outside of the storage tank.

Referring to FIG. 15B, a pump 326 may be located at an upper portion of the lower fluid channel 328, more specifically, under the ceiling of the lower fluid channel 328. The pump 326 is provided at an upper side thereof with a pipe 324, through which the liquefied gas is discharged to the outside, and at a lower side thereof with a suction pipe 326*a* extending therefrom. Here, the suction pipe 326*a* may be omitted depending on the size or installation height of the pump 326. Unlike the embodiment shown in FIG. 15A, the pump 326 is disposed inside the lower fluid channel 328 and only the pipe 324 is disposed inside the longitudinal cofferdam 107. In other words, the pump is exposed to the liquefied gas.

The pump 323 or 326 and the pipe 324 may be selected from any pump and pipe, which are used for the conventional liquefied gas storage tank or which are newly developed. The invention is not limited to the specifications of the pump 323 or 326 and the pipe 324.

As such, according to the third embodiment, the pump 323 or 326 and the pipe 324 may be provided to the longitudinal cofferdam 107, which is provided to the storage tank 320 to lower the influence of the sloshing phenomenon of the liquefied gas therein. As a result, according to the third embodiment, problems relating to vibration of the pump tower, thermal deformation, sloshing, and the like can be significantly solved, as compared to the storage tank having the pump and the pipe disposed therein.

Further, as compared to the storage tank having the pump tower extending from the bottom of the storage tank to the ceiling thereof, the storage tank according to the third embodiment can reduce manufacturing time and costs, thereby improving productivity.

Figure 16:
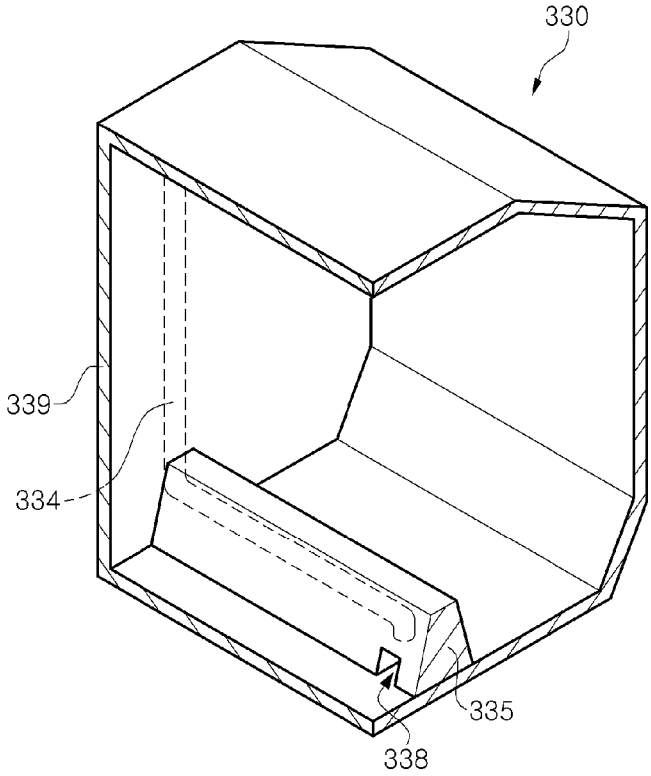
FIG. 16 is a partially cutaway perspective view of a liquefied gas storage tank in accordance with a modification of the third embodiment of the present disclosure.

FIG. 16 is a partially cutaway perspective view of a liquefied gas storage tank in accordance with a modification of the third embodiment of the present disclosure. In FIG. 16, the liquefied gas tank is formed therein with a projection wall having a predetermined height, instead of the longitudinal cofferdam formed in the longitudinal direction of the marine structure.

Referring to FIG. 16, a liquefied gas storage tank 330 according to this modification includes a projection wall 335 which protrudes to a predetermined height from the bottom of the storage tank to reduce the influence by the sloshing phenomenon of LNG in the storage tank.

In the third embodiment, the longitudinal cofferdam 107 is formed from the bottom of the storage tank to the ceiling thereof, thereby completely dividing the interior space of the hull 101. On the contrary, in the storage tank 330 of this modification, the projection wall 335 protrudes to a predetermined height from the bottom of the storage tank, thereby dividing a lower space of the storage tank without dividing an upper space thereof.

Unlike the partition formed separately from the liquefied gas storage tank, the projection wall 335 may be integrally formed with the storage tank 330 by deforming the shape thereof. In other words, a thermal insulation wall and a sealing wall of the storage tank 330 continue without being disconnected at the partition wall 335 to define a completely sealed storage space in the storage tank 330.

The projection wall 335 may have any height so long as it can effectively reduce the influence of the sloshing phenomenon.

In this modification, the projection wall 335 is formed at a lower portion thereof with at least one lower fluid channel 338. The lower fluid channel 338 allows the liquefied gas to flow between both divided spaces of the storage tank 330.

The number and shape of the lower fluid channels 338 do not limit the invention and may be appropriately modified in consideration of the size of the storage tank 330 and the like.

Further, the lower fluid channel 338 may be thermally insulated to prevent heat transfer from the exterior of the storage tank 330. In this case, any heat-insulating method currently applied to the membrane type storage tank or the independent type storage tank may be used.

As in the third embodiment, according to this modification, the pump 323 or 326 and the pipe 324 are disposed at the upper portion of the lower fluid channel 328 (see FIGS. 15A and 15B). Since the configuration of the pump disposed on the top of the ceiling or under the ceiling of the lower fluid channel 338 is the same as that of the third embodiment, a detailed description thereof will be omitted herein.

On the other hand, since the projection wall 335 of this modification is not extended to the ceiling of the liquefied gas storage tank 330, the pipe 324 is horizontally extended along the projection wall 335 to a front wall (or rear wall) 339 of the storage tank 330 and is then vertically extended along the front wall (or rear wall) 339, as shown in FIG. 16, to prevent the pipe 324 from being exposed to the liquefied gas.

Figure 17:
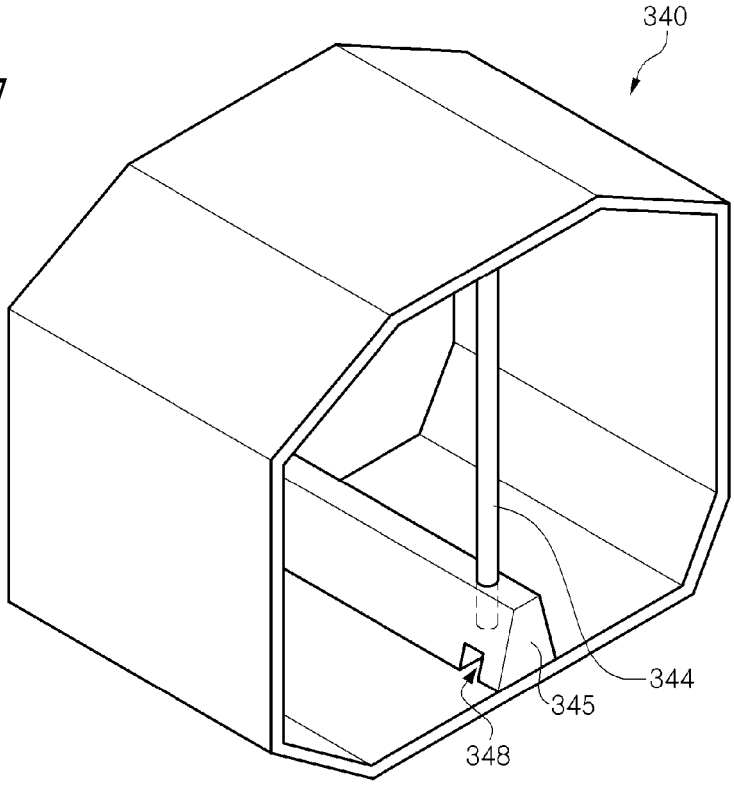
FIG. 17 is a partially cutaway perspective view of a liquefied gas storage tank in accordance with another modification of the third embodiment of the present disclosure.

FIG. 17 is a partially cutaway perspective view of a liquefied gas storage tank in accordance with another modification of the third embodiment of the present disclosure. In FIG. 17, the liquefied gas tank is formed with a projection wall having a predetermined height instead of the longitudinal cofferdam formed in the longitudinal direction of the marine structure.

Referring to FIG. 17, a liquefied gas storage tank 340 according to this modification includes a projection wall 345 and a lower fluid channel 348, which have the same configurations as those of the modification shown in FIG. 16, and a pipe 344 extending to an upper portion of the projection wall 345. A detailed description of the same configurations as those of the modification shown in FIG. 16 will be omitted herein.

In this modification, since the projection wall 345 is not extended to the ceiling of the storage tank 340, an upper portion of the pipe 344 can be partially exposed to the liquefied gas as shown in FIG. 17.

According to the modifications of the third embodiment, the pump 323 and the pipe 334 or the partially extended pipe 344 may be disposed in the projection wall 335 or 345, which is installed to reduce the influence by the sloshing phenomenon of LNG stored in the storage tank 330 or 340. As a result, according to the modifications of the third embodiment, problems relating to vibration, thermal deformation, sloshing, and the like can be significantly solved, as compared to the storage tank having the pump, pipe and pump tower therein.

Further, according to one of the modifications of the third embodiment, since a lower end of the pipe 344 is inserted into the projection wall 345 and secured thereto unlike a conventional pump tower which is not secured at a lower end thereof, it is possible to solve the problems relating to vibration of the pump tower and the like and to reduce costs for manufacturing and installation of the pump tower and the like, thereby improving productivity.

As described above, according to the third embodiment, the reinforcement structure, such as the cofferdam or the projection wall, is provided to suppress the sloshing phenomenon, so that the interior space of the hull is divided into two spaces by the reinforcement structure to receive two rows of storage tanks in the respective spaces inside the marine structure. Even in this case, however, the storage tank can be efficiently operated by providing each pair of storage tanks with equipment including a pump, a pump tower, and a gas dome for discharging the liquefied gas and boil-off gas to the outside. Accordingly, manufacturing costs of the liquefied gas storage tanks can be reduced and operation and management of the storage tanks can be easily carried out.

According to other embodiments of this disclosure, the interior spaces of the hull may be divided into two or more spaces by a plurality of longitudinal cofferdams and transverse cofferdams such that two or more rows of liquefied gas storage tanks may be arranged inside the marine structure.

As apparent from the above description, according to the embodiments, two rows of liquefied gas storage tanks can be arranged at opposite sides of a longitudinal cofferdam disposed in the longitudinal direction inside a hull of a marine structure.

In the two rows of liquefied gas storage tanks, each of the storage tanks has a sealing wall and a thermal insulation wall extending without being disconnected, so that the sealing wall and the thermal insulation wall completely surround an interior space of the storage tank. As a result, sealing and thermal insulation of the storage tank can be perfectly accomplished.

Further, according to the embodiments, since the longitudinal cofferdam is longitudinally disposed between the storage tanks arranged in two rows, the interior space of each of the storage tank is reduced in size even though the marine structure is increased in size, so that a flow of a liquefied gas can be effectively suppressed, thereby minimizing the sloshing phenomenon.

Moreover, according to the embodiments, the longitudinal cofferdam supports the load of the upper structure, thereby enabling convenient disposition of the upper structure when designing a marine structure.

The various embodiments described above can be combined to provide further embodiments. All of the patents, patent application publications, patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed:

1. A liquefied gas storage tank received in a marine structure to store a liquefied gas, comprising:

a plurality of liquefied gas storage tanks respectively received in a plurality of spaces defined by a cofferdam in a hull of the marine structure, the liquefied gas storage tanks arranged in a plurality of rows inside the marine structure, the cofferdam comprising at least one longitudinal cofferdam extending in a longitudinal direction of the hull and at least one transverse cofferdam extending in a transverse direction of the hull, wherein each of the liquefied gas storage tanks is sealed and thermally insulated by a sealing wall and a thermal insulation wall extending without being disconnected, wherein the longitudinal cofferdam comprises bulkheads and a void therebetween, and is provided with a cofferdam heater to supply heat into the void of the longitudinal cofferdam, wherein the cofferdam heater comprises a pipe disposed in the longitudinal cofferdam and a pump to transfer a heat exchange medium in the pipe, wherein a fluid channel is defined in the void of the longitudinal cofferdam between two adjacent liquefied gas storage tanks to allow a cargo received in the two adjacent storage tanks, which are arranged at opposite sides of the void, to move therebetween through the fluid channel, wherein the fluid channel comprises an upper fluid channel defined at an uppermost portion in the void of the longitudinal cofferdam to be adjacent to the ceilings of the liquefied gas storage tanks so as to allow boil-off gas to move between the two adjacent storage tanks, and wherein the upper fluid channel is sealed and thermally insulated to prevent heat transfer between an inner portion of the upper fluid channel and the void of the longitudinal cofferdam.

2. The storage tank according to claim 1, wherein the fluid channel penetrates the longitudinal cofferdam to allow the two storage tanks adjacent to each other in a width direction of the marine structure to communicate with each other through the fluid channel.

3. The storage tank according to claim 1, wherein the fluid channel comprises a lower fluid channel defined at a lower portion of the cofferdam to allow the liquefied gas to move between the two adjacent storage tanks.

4. The storage tank according to claim 3, wherein the lower fluid channel is defined adjacent to bottoms of the storage tanks.

5. The storage tank according to claim 1, wherein the upper fluid channel is defined adjacent to ceilings of the storage tanks.

6. The storage tank according to claim 1, wherein the longitudinal cofferdam is connected to a bottom and/or a ceiling of the storage tank substantially in a vertical direction.

7. The storage tank according to claim 1, wherein the cofferdam comprises another pump and a pipe disposed therein to discharge the liquefied gas stored in the storage tanks.

8. The storage tank according to claim 7, wherein the cofferdam comprises a lower fluid channel defined at a lower portion of the cofferdam to allow the liquefied gas stored in two adjacent liquefied gas storage tanks to move therebetween through the lower fluid channel, and the other pump is disposed at an upper portion of the lower fluid channel inside the cofferdam.

9. The storage tank according to claim 3, wherein the lower fluid channel is provided therein with a pump to discharge the liquefied gas stored in the storage tanks and the cofferdam is provided therein with a pipe acting as a discharge passage of the liquefied gas discharged by the pump.

10. The storage tank according to claim 1, wherein the cofferdam heater further comprises a heating mechanism to supply heat to the heat exchange medium.

11. The storage tank according to claim 10, wherein the heating mechanism is one selected from a heat exchanger, an electrical heater, and a boiler disposed inside the marine structure and requiring cooling.

12. The storage tank according to claim 1, wherein each of the liquefied gas storage tanks is a membrane type tank.

13. A marine structure configured for use in a floating state at sea and having a storage tank for storing a liquid cargo in a cryogenic state, the marine structure comprising:

cofferdams disposed in longitudinal and transverse directions inside the marine structure to divide an interior space of a hull of the marine structure into a plurality of spaces; and a plurality of storage tanks received in the respective spaces and arranged in at least two rows;

wherein a longitudinal cofferdam comprising bulkheads and a void therebetween is provided with a cofferdam heater to supply heat into the void of the longitudinal cofferdam; and wherein the cofferdam heater comprises a pipe disposed in the longitudinal cofferdam and a pump to transfer a heat exchange medium in the pipe, wherein a fluid channel is defined in the void of the longitudinal cofferdam between two adjacent liquefied gas storage tanks arranged at opposite sides of the void to allow a cargo received in the two adjacent storage tanks to move therebetween through the fluid channel, wherein the fluid channel comprises an upper fluid channel defined at an uppermost portion in the void of the longitudinal cofferdam to be adjacent to ceilings of the liquefied gas storage tanks so as to allow boil-off gas to move between the two adjacent storage tanks, and wherein the upper fluid channel is sealed and thermally insulated to prevent heat transfer between an inner portion of the upper fluid channel and the void of the longitudinal cofferdam.

14. The marine structure according to claim 13, wherein the marine structure is one selected from an LNG (liquefied natural gas) FPSO (floating, production, storage and offloading), an LNG FSRU (floating storage and regasification unit), an LNG carrier, and an LNG RV (regasification vessel).

15. The marine structure according to claim 13, wherein each of the liquefied gas storage tanks is a membrane type tank.

* * * * *